US005926976A

United States Patent [19]

Cretinon et al.

[11] Patent Number: 5,926,976

[45] Date of Patent: Jul. 27, 1999

[54] SPORT BOOT

[75] Inventors: Frederic Cretinon, Metz-Tessy; Catherine Fellouhe, Annecy-le-Vieux, both of France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,702

[22] Filed: Jun. 12, 1997

[30] Foreign Application Priority Data

Jun. 17, 1996 [FR] France ..... 96 07788

[51] Int. Cl.[6] ..... A43B 23/00; A43C 11/00

[52] U.S. Cl. ..... 36/45; 36/50.1

[58] Field of Search ..... 36/45, 91, 50.1, 36/169

[56] References Cited

U.S. PATENT DOCUMENTS

| | | | |
|---|---|---|---|
| 2,147,197 | 2/1939 | Glidden | 36/45 |
| 2,572,948 | 10/1951 | Poon | 36/45 |
| 3,768,182 | 10/1973 | Powers . | |
| 4,258,480 | 3/1981 | Famolare, Jr. | 36/91 |
| 4,342,161 | 8/1982 | Schmohl | 36/50.1 |
| 4,550,511 | 11/1985 | Gamm | 36/91 |
| 4,766,681 | 8/1988 | O'Rourke et al. | 36/50.1 |
| 5,465,509 | 11/1995 | Fuerst et al. | 36/91 |
| 5,497,564 | 3/1996 | Allen et al. | 36/45 |

FOREIGN PATENT DOCUMENTS

| | | |
|---|---|---|
| 569694 | 4/1924 | France . |
| 2694167 | 2/1994 | France . |
| 160318 | 3/1921 | United Kingdom . |
| 207101 | 11/1923 | United Kingdom . |
| 363008 | 12/1931 | United Kingdom . |
| 393508 | 6/1933 | United Kingdom . |
| 1545475 | 5/1979 | United Kingdom . |

*Primary Examiner*—M. D. Patterson
*Attorney, Agent, or Firm*—Greenblum & Bernstein, P.L.C.

[57] ABSTRACT

The present invention relates to a sport boot in which the functions of tightening and protecting the foot are preformed by implementing a tightening device cooperating with at least one movable flap found outside the upper and adapted to be pressed against the latter, wherein a transverse cutout is obtained on the flank of the upper, opposite the movable flap, and wherein a thin flexible plate closes this opening from the inside of the upper, the flap being housed in the cutout during a tightening action.

35 Claims, 3 Drawing Sheets

SPORT BOOT

BACKGROUND OF THE INVENTION

1. Field of the Invention

The present invention relates to a sport boot in which the functions of tightening and protecting the foot are performed by implementing a tightening device cooperating with at least one movable flap found outside the upper and adapted to be pressed against the latter.

2. Background and Material Information

Known sport boots of this type, such as those described in the patents GB 363 008, FR 569 694, FR 2 694 167, and GB 1 545 475, have an upper that is generally provided with a front longitudinal opening on the top, and they can be adjusted on the foot by bringing the edges of the opening, i.e., the flanks of the upper, closer together by means of a tightening device capable of using at least one movable flap. As taught, the movable flap or flaps extend freely on the corresponding flanks of the upper, from an attachment zone remote from the front longitudinal opening, and located at the level of the sole of the boot. Due to these various arrangements, when a movable flap is tightened, the latter is pressed against the corresponding flank of the upper and thus biases it to become narrower in the direction of the foot, which thus results in the edges of the front longitudinal opening of the upper being brought closer together. Likewise, because of this same tightening action on a movable flap, the wall of the boot is provided with a double thickness in the flap area, because it is constituted by the wall of the flank of the upper and by that of the flap which overlap one another. The wall of the boot thus has, in the location of each movable flap, an increased resistance that notably improves the protection of the foot from the outside, especially against shocks.

Furthermore, the use of a movable flap also makes it possible to distribute a substantial portion of the tightening stresses on the latter, selectively along the zone of the upper where it extends, instead of essentially and totally on the upper, as is the case with conventional boots where the lacing exerts a direct pulling action on the latter. Indeed, these boots having at least one movable flap make it possible to ensure a proper protection as well as a tightening of the foot without direct pulling action on the upper in the location of the movable flap or flaps, since it is the latter that are secured to the tightening device. However, they have certain disadvantages related in particular to the proportioning of the tightening force on the foot and to problems of quick wear and tear and deterioration. Indeed, in this type of boots, the frictions and deformations that occur between the wall of the upper and/or the movable flap or flaps absorb a portion of the tightening force restituted by the upper on the foot.

This disadvantage is especially more sensitive as at least one of either the upper or the flap is made out of a material having a strong modulus, such as leather, as is generally the case. Furthermore, because the movable flaps of these boots are located in an excessive thickness on the wall of the flank of the upper, they constitute projecting portions that are exposed to external elements and actions, and can get caught, be torn, or even stripped, therefore likely to be prematurely worn out with respect to the boot considered in its entirety.

SUMMARY OF THE INVENTION

The object of the present invention is to remedy these disadvantages of the aforementioned boots, and it proposes in particular a tightening device cooperating with a movable flap which makes it possible to transmit, almost entirely, the tightening force that is applied thereto in the direction of the upper and therefore of the foot, and having no projecting portion on the flank of the boot upper.

Another object is to maintain in the location of the movable flap, a tightening function that is independent of the upper, i.e., with no direct action thereon, and that is further referenced with respect to the sole, due to the location of the attachment zone of the flap close to the latter.

Another object of the invention is to reduce the frictions that occur between the movable flap and the upper in order to optimize the efficiency of the tightening device.

Yet another object is to obtain a tightening assembly that can constitute a standard tightening model for a number of boot sizes.

To achieve these objects, the boot includes a sole on which an upper provided with a front longitudinal opening on the top is mounted, the upper being adjustable on the foot by bringing the edges of the longitudinal opening closer together by means of a tightening device using at least one movable flap which extends freely on the flank of the upper from an attachment zone located at the level of the sole, and wherein the upper has, on the flank where the movable flap is located, a transverse cutout whose width is at least greater than that of the flap, and which extends from the sole up to the front longitudinal opening where it ends. This transverse cutout is closed from the inside of the upper by a thin flexible plate made of a relatively resistant material, such as plastic, for example. Due to these characteristics, the movable flap gets housed in the transverse cutout by pressing on the thin flexible plate when a tightening action is exerted thereon by the tightening device, and therefore does no longer constitute a projecting portion on the flank of the upper that is likely to be prematurely worn out with respect to the boot considered in its entirety.

Advantageously, the movable flap, as the thin flexible plate, is made of a plastic material in order to reduce the frictions that occur between it and the wall of the corresponding wall of the upper, i.e., the flexible plate, on the one hand, and the risks of deformation, such as folds that could be caused by the external tightening, on the other hand. As a result, the boot upper is more adapted to the tightening because the tightening force applied on the tightening device is almost entirely restituted by the upper on the foot, and the resistance of the wall of the upper with respect to the outside is preserved due to the use of the plastic material for the flexible plate.

The boot thus designed keeps the advantages of the known boots having a tightening device using a movable flap, such as previously disclosed, without having the disadvantages thereof, especially those related to the proportioning of the tightening force on the foot and to the deterioration of the movable flap.

Preferably, the transverse cutout and the movable flap are located between the tip and the rear of the boot, substantially in correspondence with the instep zone, so that tightening is more efficient, and especially that it returns the wearer's heel in the nesting of the rear of the boot.

According to one characteristic, the thin flexible plate and the movable flap each include a fastening lug directed toward the boot sole, which lug is adapted to enable their mesh assembly with the sole, at the level of the sole. Preferably, their mesh assembly with the sole occurs on the insole. Thus, when the movable flap is used by the tightening device, the tightening effect transmitted by the flap on the upper is felt on the foot from the sole progressively up to the instep.

It is obvious that the plastic materials used for the movable flap and the thin flexible plate are provided to be compatible with the constituent material of the sole when their assembly is carried out through a common adhesion process According to another characteristic, the thin flexible plate has, on the one hand, lateral edges that extend beneath the edges that demarcate the transverse cutout, and which are adapted to enable its fixation by any known means, such as stitching, adhesion, etc., and on the other hand, an upper edge which constitutes at least one portion of the corresponding edge of the front longitudinal opening of the upper. Preferably, this upper edge of the flexible plate is extended on both sides of the transverse opening and includes, outside the zone occupied by the movable flap, at least one guide or eyelet for a lacing tie of the tightening device. An embodiment in particular consists of making a flexible plate with an upper edge which, as it extends along the entire length of the front longitudinal opening, constitutes one of the edges thereof. In such an example of construction, the upper edge of the flexible plate is provided with a plurality of guides or eyelets, in particular on the side of the tip of the boot and in the zone above the instep, which is commonly referred to as the flexion fold zone. With these arrangements, local overstretching is avoided because the tightening stresses that are exerted at the level of the guides or eyelets carried by the flexible plate and by the movable flap are distributed over a large area of the corresponding flank of the boot upper, especially along the seams, adhesions, etc., and of the assembly and attachment zone at the level of the sole.

According to an embodiment, the thin flexible plate includes at least one bead that follows at least the contour of the edges which demarcate the transverse cutout, this bead being inserted between the respective edges of the transverse cutout and of the movable flap, and having a height that corresponds substantially to the thickness of the wall of the upper, in the location of the transverse cutout and to the thickness of the wall of the movable flap.

According to a preferred embodiment, a tightening device using at least one movable flap on a traverse cutout closed by a thin flexible plate, such as described hereinabove, is located on each flank of the boot upper. Thus, the boot has a three-part overall structure, i.e., a tip that covers the forefoot, a rear which nests the heel, and a tightening assembly which, inserted between the tip and the rear, ensue the mounting of the upper assembly. As a result of such a structure, it suffices to vary the size of the tip, of the rear of the boot, and of the sole to cover a plurality of sizes, without it being necessary to change the size of the tightening assembly. The tightening assembly can therefore constitute a standard tightening model for a number of boot sizes.

Still according to this previous structure, the two thin flexible plates can be advantageously made integral or unitary with a flat and elongated portion having a contour that corresponds substantially to Cat of the foot, which constitutes the "insole". Of course, this flat and elongated plate can include, at least on a portion of its contour, a reinforcing lateral edge for the upper, which possibly forms the stiffener when this edge is positioned in the heel zone. In such a configuration, an extremely efficient tightening assembly is obtained because an actual synergy and/or interaction is produced between the assembly and the "insole" portion which, in fact, is the "floor" of the boot.

It is understood that the boot can also be obtained with a single thin flexible plate made integral or unitary with the constituent portion of the insole.

BRIEF DESCRIPTION OF DRAWINGS

The invention will be better understood upon reading the following description, with reference to the annexed schematic drawings illustrating, by way of example, an embodiment of a boot including it, and in which.

DETAILED DESCRIPTION OF THE PREFERRED EMBODIMENTS

Figure 1:
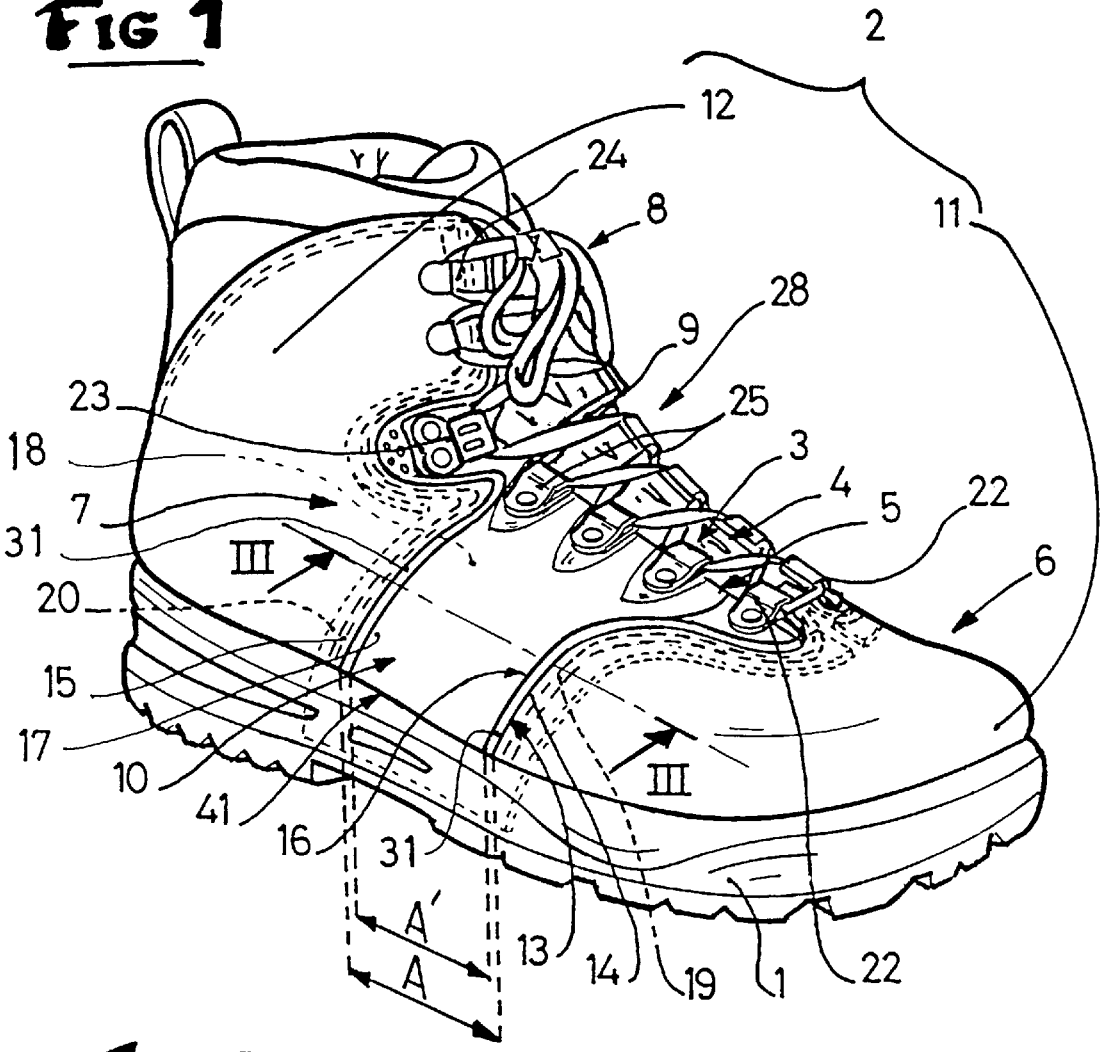
FIG. 1 shows a perspective view of the boot provided with a tightening device with a movable flap on each flank of the upper in the closed position.

The boot shown by way of example in FIG. 1 is of the "multi-activities" type and includes, in a known runner, an external sole 1 on which is mounted an upper 2 having a tip 11 which covers the fore-foot and a rear 12 which nests the heel. The upper 2 is provided with a front longitudinal opening 3 on the top, demarcated by edges 4 and 5 which form the upper end of the flanks 6 and 7 of the upper 2. This opening 3 is adapted to enable the passage of the wearer's foot, not shown, during fitting and removal of the boot, and to enable the adjustment of the upper 2 on the foot by bringing its edges 4 and 5 closer together by means of a tightening device 8 having a lace 9 and eyelets 22, 23, 24, 25, using a movable flap 10 on each of the flanks 6 and 7. Each movable flap 10 extends freely on the corresponding flap 6, 7, of the upper 2 from an assembly zone 41 located at the level of the sole 1, i.e., remote from the longitudinal opening 3. Thus, when the flap 10 is subjected to a tightening action of the tightening device 8 with lace 9 to which it is connected via its eyelets 25, it is pressed against the flank 6, 7, by causing the latter to tighten in the direction of the foot, without exerting any pulling action on the upper 2.

Figure 2:
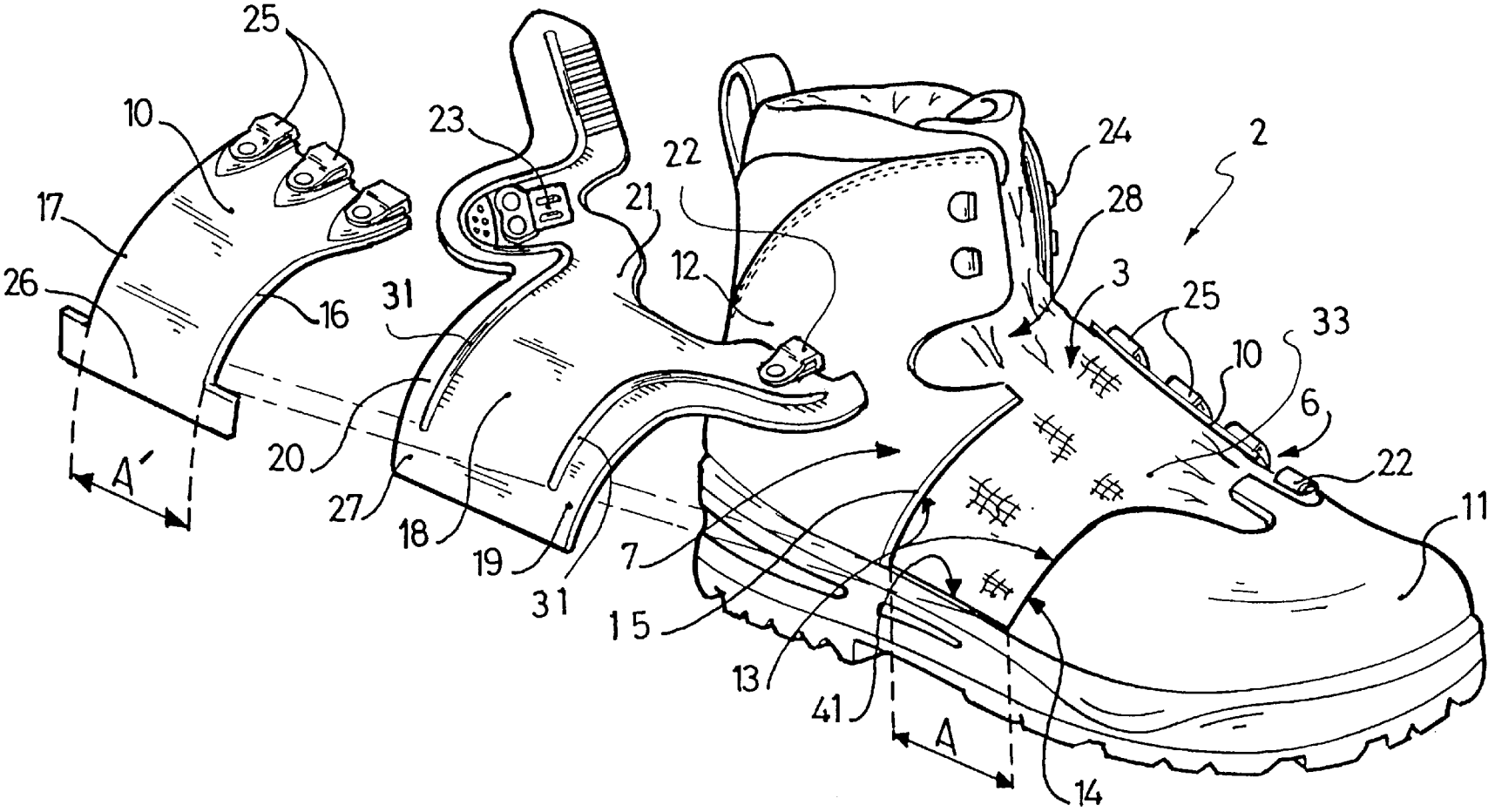
FIG. 2 shows a partially exploded view of the boot of FIG. 1 with some of its characteristics.
Figure 4:
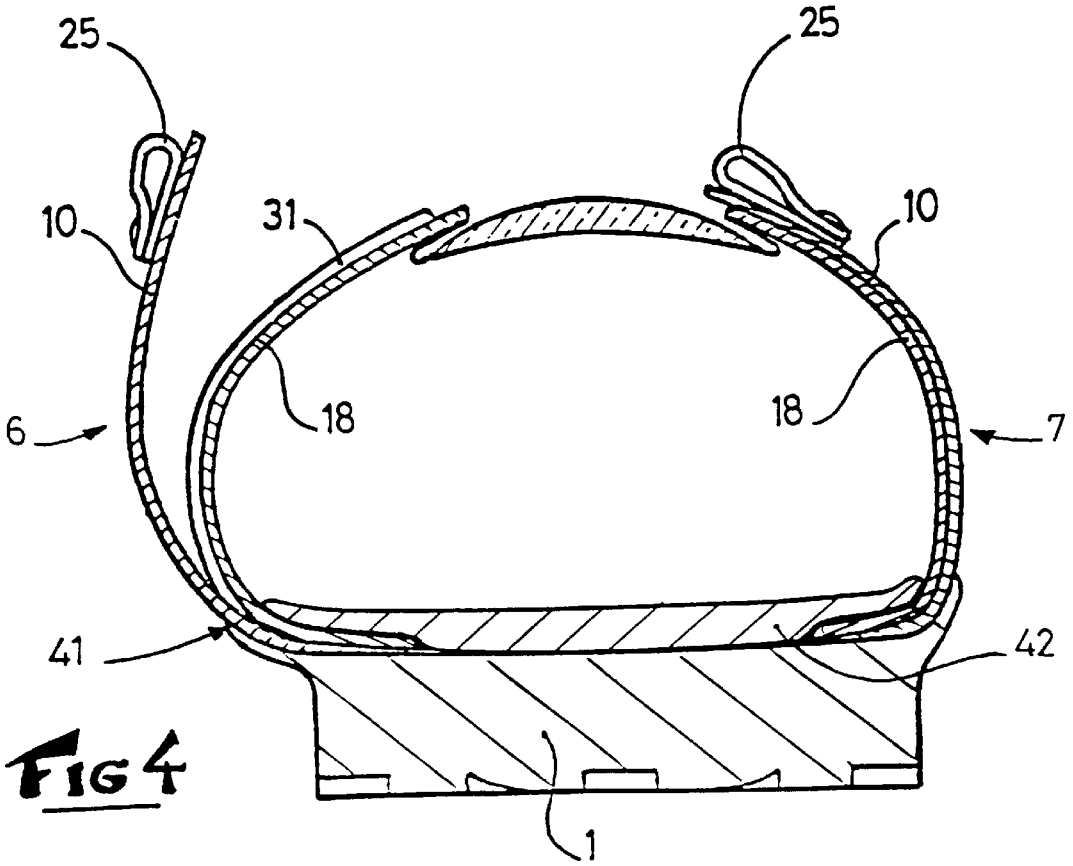
FIG. 4 is a transverse cross sectional view of the boot of FIG. 1, along the line IV—IV, illustrating a movable flap pressed against the corresponding flap of the upper and a movable flap spaced apart.

According to a characteristic, that is more particularly visible in FIG. 2, the upper 2 includes, on each flank 6, 7, and opposite each movable flap 10, a transverse cutout 13 that is closed from the inside of the upper 2 by a thin flexible plate 18. The edges 14 and 15 of this transverse cutout 13 are spaced apart by a width A at least greater than that A' of the lateral edges 16 and 17 of the movable flap 10, such that during the tightening action on the flap 10, the latter is housed in the cutout 13 and is flush with the external surface of the upper 2 while tightening Se flank 6, 7, thereof by resting against the flexible plate 18 positioned beneath, as shown in detail in FIG. 3.

The thin flexible plate 18, as well as the flap 10, is made of a relatively resistant material such as plastic, and its lateral edges 19, 20, extend beneath the edges 14 and 15 of the cutout 13 in order to enable its attachment by any known means, such as adhesion, stitching, etc. Advantageously, the upper edge 21 of each flexible plate 18 extends on both sides of the edges 14 and 15 of the transverse cutout 13 and constitutes almost the entire corresponding edge 4 or 5 of the longitudinal opening 3 so that guides or eyelets 22, 23 and/or 24, can be attached or fixed thereon. Thus, local overstretching on the upper 2 is avoided because the tightening stresses that are exerted on the guides or eyelets 22, 23, and/or 24, are distributed from the flexible plate 18 over a large area of the corresponding flank 6, 7, of the upper 2, along the seams, adhesions, etc.

By way of example, in the present embodiment shown, the upper edge 21 of the flexible plate 18 is especially provided with a guide 22 located on one side of the tip 11 of the upper 2 and with a guide 23 located toward the rear 12, in the flexion fold zone designated by the reference numeral 28, i.e., above the instep. Preferably, the transverse cutout 13 extends from the sole 1 up to the longitudinal opening 3, such as illustrated in FIG. 2, so that the flexible plate 18 as well as the movable flap 10 can be interlocked, i.e., mesh assembled, via 41, with the sole 1, and at level of the latter, by means of a fastening lug 26, 27, respectively. Preferably, the thin flexible plate 18 and the movable flap 10 are assembled on the "insole" 42. With these arrangements, when the tightening device 8 uses the movable flap 10, the tightening effect is felt on the foot from the sole 1 which serves as a reference point. With the same arrangements, the upper 2 of the boot is in fact divided into three distinct pans, i.e., a tip portion 11 of the boot, a rear portion 12, and an intermediate portion constituted by a "tightening assembly" on each flank 6, 7, this assembly including the cutout 13, the plate 18 and the movable flap 10.

Therefore, it suffices to vary the size of the tip 11 and/or of the rear 12 of the upper 2, and of the sole 1, to cover a plurality of sizes with a single tightening assembly.

For tightening efficiency, each transverse cutout 13 is obtained on each flank 6, 7, between the tip 11 and the rear 12 of the upper 2 in correspondence with the instep zone. In this way, the tightening has the effect of returning the wearer's heel in the nesting of the rear 12.

According to a construction detail, visible in FIGS. 1–4, the thin flexible plate 18 includes a bead 31 which follows at least the contour of the edges 14 and 15 of the transverse is cutout 13. This bead 31 is inserted laterally between the edges 14 and 15 of the cutout 13 and the edges 16 and 17 of the movable flap 10, and has a height corresponding substantially to the thickness of the wall of the upper 2 in the location of the transverse cutout 13 and to the thickness of the wall of the movable flap 10.

Figure 3:
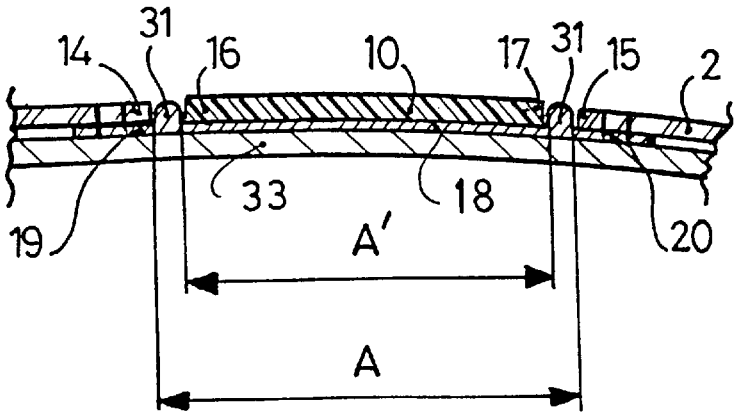
FIG. 3 is a cross sectional view along the line III—III of the boot of FIG. 1 showing a detail of construction.

Of course, the boot according to the invention can include an inner comfort lining 33, as shown in FIGS. 2 and 3.

Figure 5:
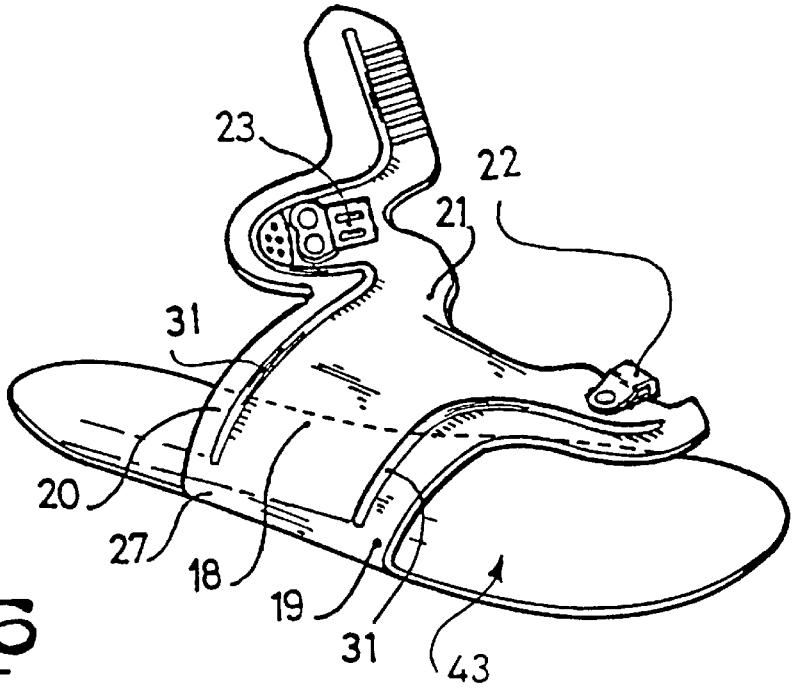
FIG. 5 illustrates an embodiment of a characteristic element of the invention.

Particular accommodations, such as aeration-ventilation means or systems can of course be adapted to the tightening assembly described, and in particular to the thin flexible plate 18 without departing from the scope of the invention. Likewise, as shown in FIG. 5, by way of example, and for simplicity at least one thin flexible plate 18 can be made unitary with a flat and elongated portion 43 having a contour corresponding substantially to that of the foot, which constitutes the "insole". Advantageously, in the case of the preceding boot structure, with reference to FIGS. 1–4, wherein a tightening device 8 having a movable flap 10 and a flexible plate 18 is used on each flank 6, 7; it is the two flexible plates 18 that are made integral with the portion 43 forming the insole. A very homogenous tightening assembly is thus obtained because its various components, flap 10, plate 18, device 8, and insole 43 interact with one another.

The form of the cutout 13 and/or of the movable flap 10 is limited by edges 14, 15 and 16, 17, which can selectively be parallel or not, the edge 14, 16, with respect to the edge 15, 17, or the edges 14, 15, with respect to the edges 16, 17.

The opening 13 as well as the flap 10 can have a shape that flares out from the sole 1 toward the opening 3, toward the tip 11 and/or the rear 12 of the upper 2.

The present application is based upon the French Priority Pat. Application No. 96.07788, filed on Jun. 17, 1996, the disclosure of which is hereby expressly incorporated by reference thereto, and the priority of which is hereby claimed under 35 U.S.C. §119.

What is claimed:

1. A boot comprising:

a sole;

an upper attached to and extending upwardly from said sole, said upper including opposite first and second flanks and a top having a front longitudinal opening, said front longitudinal opening being defined by longitudinally extending edges;

a tightening device for adjusting the tightness of said upper on the foot of a wearer of the boot by adjusting a spacing between said longitudinally extending edges, said tightening device comprising at least one movable flap secured with respect to said sole and extending freely upwardly from an attachment zone and being movable with respect to said first flank and being adapted to be positioned upon said first flank, said movable flap having a pair of lateral edges spaced apart a predetermined width;

said first flank of said upper having a transverse cutout defined by a pair of edges extending in a direction from said sole to said front longitudinal opening, said edges of said transverse cutout being spaced apart by a distance at least greater than said predetermined width of said movable flap;

said first flank of said upper further including a flexible plate, said flexible plate having edges positioned beneath said edges of said transverse cutout, whereby said flexible plate closes said transverse cutout; and said movable flap being positioned upon said flexible plate in said transverse cutout, whereby said lateral edges of said movable flap are positioned between said edges of said flexible plate and whereby double thicknesses are avoided.

2. A boot according to claim 1, wherein:

the boot has a tip for covering a forefoot of the wearer and a rear within which a heel of the wearer is to be nested; and said transverse cutout and said movable flap are positioned between said tip and said rear.

3. A boot according to claim 1, wherein:

each of said flexible plate and said movable flap includes a respective fastening lug, said fastening lugs being mesh assembled with said sole.

4. A boot according to claim 1, wherein:

the boot further comprises an insole positioned upon said sole; and each of said flexible plate and said movable flap includes a respective fastening lug, said fastening lugs being mesh assembled with said sole and with said insole.

5. A boot according to claim 4, wherein:

said flexible plate is unitary with said insole.

6. A boot according to claim 1, wherein:

said edges of said flexible plate, positioned beneath said edges of said transverse cutout, are affixed to said edges of said transverse cutout.

7. A boot according to claim 6, wherein:

said edges of said flexible plate are affixed to said edges of said transverse cutout by means of adhesive.

8. A boot according to claim 6, wherein:

said edges of said flexible plate are affixed to said edges of said transverse cutout by means of stitching.

9. A boot according to claim 1, wherein:

said cutout flares out from said sole to said front longitudinal opening at least in a frontward direction.

10. A boot according to claim 1, wherein:

said distance between said edges defining said cutout increases in relation to increased distance from said sole.

11. A boot according to claim 1, wherein:

said flexible plate has an upper edge constituting at least a part of said longitudinally extending edges defining said front longitudinally extending opening.

12. A boot according to claim 11, wherein:

said tightening device comprises a lace; and said upper edge of said flexible plate includes at least one guide for said lace.

13. A boot according to claim 12, wherein:

said movable flap flares out from said attachment zone to said front longitudinal opening; and said movable flap includes at least one guide for said lace at said front longitudinal opening.

14. A boot according to claim 1, wherein:

said tightening device comprises a lace;

said movable flap flares out from said attachment zone to said front longitudinal opening; and said movable flap includes at least one guide for said lace at said front longitudinal opening.

15. A boot according to claim 1, wherein:

each of said edges of said first flank defining said transverse cutout has a predetermined contour;

said flexible plate has a bead spaced from each of respective ones of said edges of said flexible plate and extending along at least said predetermined contours of said edges of said transverse cutout, said beads being positioned between respective edges of said cutout and said movable flap, said beads having a height corresponding substantially to a thickness of said first flank of said upper in an area of said transverse cutout and to a thickness of said movable flap.

16. A boot according to claim 15, wherein said lateral edges of said movable flap follow, at least partially, said predetermined contour of said transverse cutout.

17. A boot according to claim 1, wherein:

said flexible plate is made of plastic.

18. A boot according to claim 1, wherein:

said attachment zone from which said movable flap extends upwardly is located at a level of said sole.

19. A boot according to claim 1, wherein:

said flexible plate is a thin plastic flexible plate.

20. A boot according to claim 1, wherein:

said flexible plate has a thickness less than a thickness of a remainder of said upper.

21. A boot according to claim 1, further comprising:

a comfort lining positioned within said upper.

22. A boot comprising:

a sole;

an upper attached to and extending upwardly from said sole, said upper including opposite first and second flanks and a top having a front longitudinal opening, said front longitudinal opening being defined by longitudinally extending edges;

a tightening device for adjusting the tightness of said upper on the foot of a wearer of the boot by adjusting a spacing between said longitudinally extending edges, said tightening device comprising a pair of movable flaps secured with respect to said sole and extending freely upwardly from respective attachment zones and being movable with respect to said first and second flanks and being adapted to be positioned upon respective ones of said first flank and said second flank, each of said movable flaps having a pair of lateral edges spaced apart a predetermined width;

each of said first flank and said second flank of said upper having respective transverse cutouts defined by a pair of edges extending in a direction from said sole to said front longitudinal opening, said edges of said transverse cutout being spaced apart by a distance at least greater than said predetermined width of a respective one of said movable flaps;

each of said first flank and said second flank of said upper further including a respective flexible plate, each said flexible plate having edges positioned beneath said edges of a respective one of said transverse cutouts, whereby each of said flexible plates closes a respective one of said transverse cutouts; and each of said movable flaps being positioned upon a respective one of said flexible plates in a respective one of said transverse cutouts, whereby said lateral edges of each of said movable flaps are positioned between said edges of a respective flexible plate, and whereby double thicknesses are avoided.

23. A boot according to claim 11, wherein:

the boot has a tip for covering a forefoot of the wearer and a rear within which a heel of the wearer is to be nested; and said transverse cutouts and said movable flaps are positioned between said tip and said rear.

24. A boot according to claim 23, wherein:

each of said flexible plates and said movable flaps includes a respective fastening lug, said fastening lugs being mesh assembled with said sole.

25. A boot according to claim 22, wherein:

the boot further comprises an insole positioned upon said sole; and each of said flexible plates and said movable flaps includes a respective fastening lug, said fastening lugs being mesh assembled with said sole and with said insole.

26. A boot according to claim 25, wherein:

at least one of said flexible plates is unitary with said insole.

27. A boot according to claim 22, wherein:

each of said flexible plates has an upper edge constituting at least a part of said longitudinally extending edges defining said front longitudinally extending opening.

28. A boot according to claim 27, wherein:

said tightening device comprises a lace; and said upper edge of each of said flexible plates includes at least one guide for said lace.

29. A boot according to claim 28, wherein:

each of said movable flaps flares out from a respective one of said attachment zones to said front longitudinal opening; and each of said movable flaps includes at least one guide for said lace at said front longitudinal opening.

30. A boot according to claim 22, wherein:

said tightening device comprises a lace;

each of said movable flaps flares out from said attachment zone to said front longitudinal opening; and each of said movable flaps includes at least one guide for said lace at said front longitudinal opening.

31. A boot according to claim 22, wherein:

each of said flexible plates is made of plastic.

32. A boot according to claim 22, wherein:

said attachment zone from which each of said movable flaps extends upwardly is located at a level of said sole.

33. A boot according to claim 22, wherein:

each of said flexible plates is a thin plastic flexible plate.

34. A boot according to claim 22, wherein:

each of said flexible plates has a thickness less than a thickness of a remainder of said upper.

35. A boot according to claim 22, further comprising:

a comfort lining positioned within said upper.

* * * * *